United States Patent [19]

Nishimori

[11] Patent Number: 4,711,554

[45] Date of Patent: Dec. 8, 1987

[54] SCANNING TYPE COPYING MACHINE

[75] Inventor: Kadotaro Nishimori, Toyokawa, Japan

[73] Assignee: Minolta Camera Kabushiki Kaisha, Osaka, Japan

[21] Appl. No.: 939,366

[22] Filed: Dec. 8, 1986

[30] Foreign Application Priority Data

Dec. 13, 1985 [JP] Japan ..... 60-281525

[51] Int. Cl.[4] ..... G03G 15/00; G03G 15/28

[52] U.S. Cl. ..... 355/8; 355/14 E; 355/25; 355/82

[58] Field of Search ..... 355/7, 8, 14 E, 25, 355/82

[56] References Cited

U.S. PATENT DOCUMENTS 4,017,173 4/1977 Komori et al. .

4,618,244 10/1986 Watanabe ..... 355/8

FOREIGN PATENT DOCUMENTS 542134 6/1977 Japan .

5745564 9/1980 Japan .

*Primary Examiner*—Peter S. Wong

*Assistant Examiner*—Emanuel Todd Voeltz

*Attorney, Agent, or Firm*—Price, Gess & Ubell

[57] ABSTRACT

In a scanning type copying machine of the present invention, a scanner scans divided regions of a document prior to real copy operation when a dividing copy mode is selected by a book copy mode selection key. Density control data in the respective divided regions are stored in memory and an exposure lamp is controlled by a MPU so that a copy of an appropriate density can be formed according to the stored density control data. Thus, without being unfavorably influenced by a difference of the densities in the divided regions of the document, copies of appropriate densities can always be obtained.

7 Claims, 18 Drawing Figures

EIG.9C

SCANNING TYPE COPYING MACHINE

BACKGROUND OF THE INVENTION

1. Field of the Invention

This invention relates to a scanning type copying machine. More particularly, this invention relates to a scanning type copying machine having an automatic image density control means and capable of copying a document such as a book by dividing the area of the document to be copied.

2. Description of the Prior Art

Copying machines having automatic image density control means are now put into practical use. As the prior art, Japanese Patent Laying-Open Gazette No. 2134/1979 discloses an automatic exposure control mechanism of a copying machine. According to this application, a density of a document is measured while a document table moves from an initial position to an exposure start position, so that the measured value is used for control of an exposure amount at the time of projecting an image of the document onto a photoreceptor. In addition, according to Japanese Patent Laying-Open Gazette No. 45564/1982, a density of a document is measured during transport of the document by an automatic document feeder and the measured value is used for control of the density for copy operation, namely, for development bias control. By using such automatic image density control means, a copy not fogged nor dimmed can be obtained automatically without error compared with a copy obtained by manually setting a density of a document.

On the other hand, irrespective of whether automatic image density control means is provided or not, copying machines having a dividing copy mode convenient for copying of a book or the like are known. One of such copying machines is disclosed in U.S. Pat. No. 4,017,173. The copying machine of this patent has a dividing copy mode and a normal copy mode. In the dividing copy mode of this patent, an opened book is placed on a document table and the respective opened pages are individually scanned by one copy start operation so that two copies are obtained. Such a copying machine having the dividing copy mode has advantages that such troublesome work as cutting of copies into halves is not required and binding of copies is easy compared with the case of copying a book in the normal copy mode.

Meanwhile, it may be proposed to apply the above described dividing copy mode to a copying machine comprising automatic image density control means. More specifically, a copying machine, according to such proposal, is adapted to detect an image density by preliminary scanning of the opened pages of a book regarded as one sheet and the optimum exposure amount is determined based on the detected image density so that two copies of appropriate density can be obtained by consecutive two scanning operations with the same exposure amount.

However, if the densities of the bases of the opened two pages are different, or if one of the two pages contains a region of a high density such as a photograph or a picture, it is pointed out that an exposure amount to be applied for such a copy operation is not suited to either of the opened pages.

SUMMARY OF THE INVENTION

Therefore, a primary object of the present invention is to provide a scanning type copying machine having a normal copy mode and a dividing copy mode, in which appropriate density control data are applied to the respective divided regions in the dividing copy mode.

Briefly stated, the present invention is a scanning type copying machine having a normal copy mode and a dividing copy mode for copying a document in a divided manner and this copying machine operates as follows. When the dividing copy mode is selected by mode selecting means, scanning means scans the divided regions of a document prior to a real copy operation and density control data for the respective regions are set. Then, according to the thus set density control data, imaging means is controlled so that a copy of an appropriate density can be formed.

Thus, according to the present invention, even if the densities of the bases in the divided regions of a document are different, density control data are set for the respective regions and consequently a copy can be obtained with an appropriate exposure amount for each of the divided regions.

In a more preferred embodiment of the invention, a density of an image is detected at prescribed moments during scanning by scanning means and an average value of the thus detected data is set as the density control data.

Therefore, in the above stated preferred embodiment of the invention, if a density of an image in each of the divided regions is not uniform, a copy can be obtained with a more suitable exposure amount since the imaging means can be controlled based on the averaged density control data.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 7, 8A to 8C and 9A to 9C are illustrations for explaining a dividing copy mode.

DESCRIPTION OF THE PREFERRED EMBODIMENTS

Figure 1:
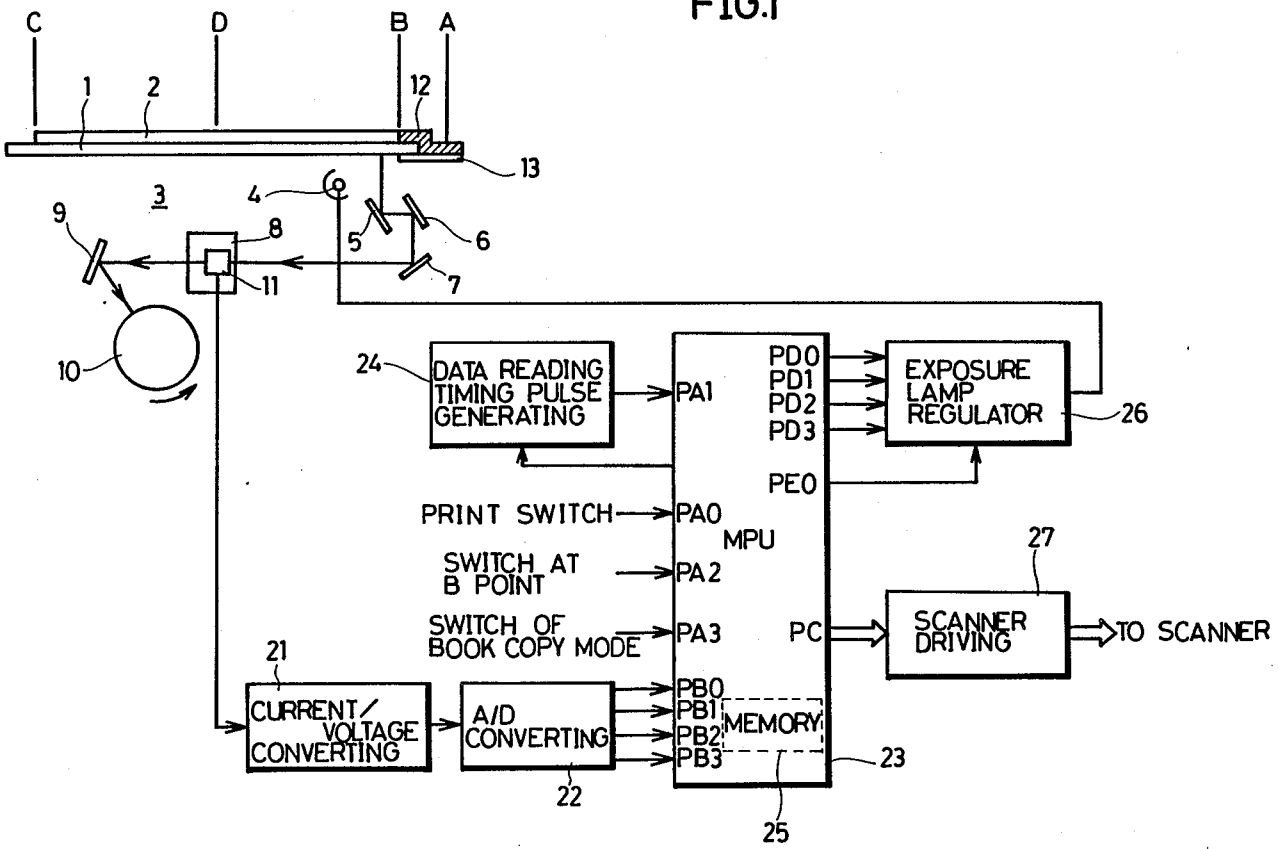
FIG. 1 is an illustration showing a construction of an embodiment of the present invention.

FIG. 1 shows schematically a scanning type copying machine of an embodiment of the present invention. A document 2 to be copied is placed on a glass document table 1. A scanning optical system 3 (referred to hereinafter as a scanner) is provided under the document table 1. The scanner 3 comprises an exposure lamp 4 for illuminating the document 2, reflection mirrors 5, 6 and 7, an imaging lens 8 and a reflection mirror 9, together with a mechanism (not shown) for operating those components in synchronism. In a copy operation, the exposure lamp 4 and the first mirror 5 move leftward in the figure to scan the document 2 and the second mirror 6 and the third mirror 7 move leftward in the figure at a speed half of the moving speed of the first mirror 5 so that the length of an imaging light path may be constant. According to the movement of the scanner 3, a photoreceptor drum 10 rotates counterclockwise as shown by the arrow in the figure, whereby an electrostatic latent image corresponding to the image of the document 2 is formed on the photoreceptor drum 10.

On the other hand, as a detecting means for detecting intensity of light reflected from the document 2, there is provided a light receiving device 11 such as a photodiode or a phototransistor in the imaging light path toward the photoreceptor drum 10. The light receiving device 11 detects an image density of the document 2 at the time of a preliminary scanning performed prior to the main scanning for a copy operation (referred to hereinafter as "main scanning").

A reference density for comparison with the document image density is detected, in this embodiment, together with the document image density at the time of preliminary scanning. More specifically, a reference white plate 13 (referred to hereinafter as "reference white") is attached to a lower portion of a document scale 12 serving also as means for fixing the document table 1 and, at the time of preliminary scanning, the scanner 3 starts scanning from the point A shown in the figure so that the density of the reference white 13 is also detected by the light receiving device 11. The document 2 an edge of which is put corresponding to an edge of the document scale 12 is scanned by the scanner 3 in a direction starting from the point B as the edge of the document scale 12 toward the point C through the point D. In connection with the point B serving as a boundary between the reference white 13 and the document 2, there is provided switch means, not shown, for detecting the position of the point B in association with the operation of the scanner 3. An on/off signal of the switching means is applied to a predetermined input port of a microprocessor unit to be described below.

At the time of preliminary scanning by the scanner 3, a current signal photoelectrically converted by the light receiving device 11 is converted to a voltage signal by a current-to-voltage converting circuit 21. The voltage signal is converted to a four-bit digital signal for example by an A/D converting circuit 22 and this four-bit digital signal is inputted to input ports PB0 to PB3 of a microprocessing unit 23 (referred to hereinafter as a MPU 23). The digital data inputted to the MPU 23 is sampled by timing pulses Tp inputted to an input port PA1 from a data reading timing pulse generating circuit 24 for generating the pulses in synchronism with movement of the scanner 3 and the sampled data is provided to the MPU 23 so that it is stored in a prescribed memory area of a RAM 25 contained in the MPU 23.

Figure 2:
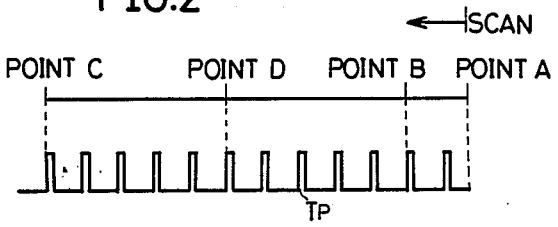
FIG. 2 is a waveform diagram of timing pulses.
Figure 3:
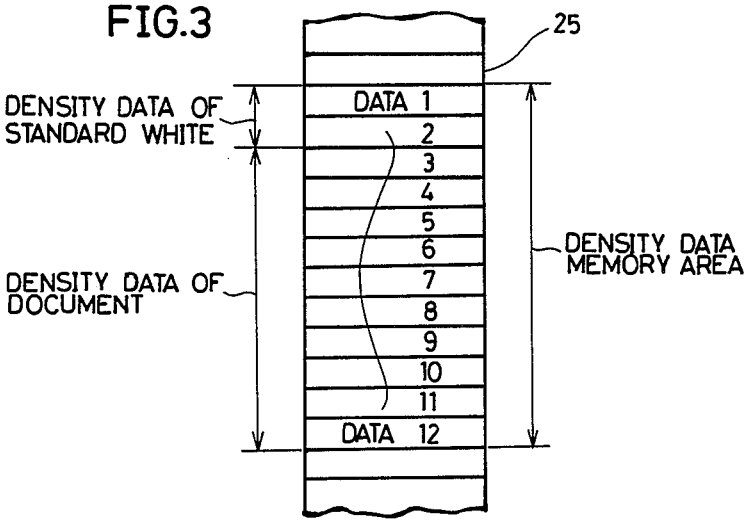
FIG. 3 is a diagram showing data stored in density data memory areas of a memory.

For example, the above stated data reading timing pulse generating circuit 24 generates twelve timing pulses with a prescribed cycle from the point A to the point C as shown in FIG. 2. More specifically, the density data of the reference white 13 from the scanning position of the point A to the scanning position of the point B is scanned twice and the density data of the document 2 from the scanning position of the point B to the scanning position of the point C is sampled ten times. The sampled density data is stored successively in density data memory areas DATA1 to DATA12 of the RAM 25 as shown in FIG. 3. The density data (4 bits) of the reference white 13 is stored in the memory areas DATA1 and DATA2 and the density data (4 bits) of the document 2 is stored in the memory areas DATA3 to DATA12.

When the scanner 3 applies preliminary scanning to an extent attaining the point C and the MPU 23 reads the density data, the scanner 3 changes reversely the scanning direction to return to the point A. During this return, a voltage value of the exposure lamp 4 suited for the image density of the document 2 is determined so that copy operation in the optimum condition can be performed by the subsequent scanning operations. More specifically, the MPU 23 evaluates the density data of the reference white 13 and the density data of the document 2 stored in the RAM 25 so as to determine an appropriate exposure amount according to the image density of the document 2. The data evaluated by the MPU 23 is outputted through output ports PD0 to PD3 to an exposure lamp regulator 26 for controlling a quantity of light of the exposure lamp 4. At the time of a main scanning for copy operation, a control signal for turning on the exposure lamp 4 is first outputted from the output port PE0 to the exposure lamp regulator 26. The exposure lamp regulator 26 enabled by this control signal applies a prescribed voltage value according to the input data from the MPU 23 to the exposure lamp 4. When a control signal for driving the scanner 3 is outputted from an output port PC of the MPU 23, the scanner 3 is driven by a scanner driving circuit 27 so that a copy operation is performed while the exposure lamp 4 applies to the document 2 a prescribed exposure amount according to the image density of the document 2.

Figure 4:
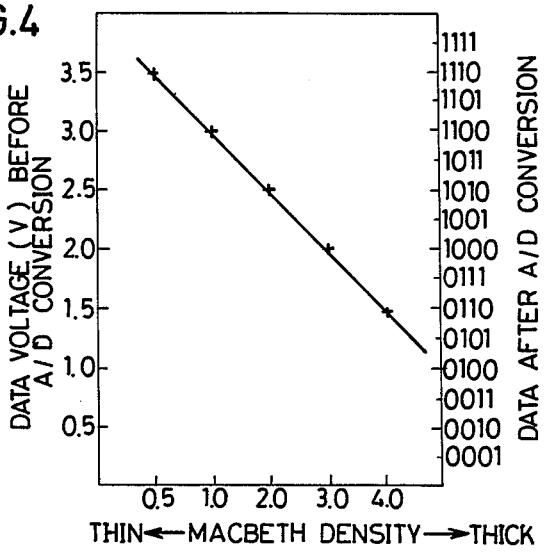
FIGS. 4, 5 and 6 are graphs for explaining automatic exposure control in an embodiment of the present invention.

In the following, an automatic exposure control technique of this embodiment will be specifically described. As shown in FIG. 4, the Macbeth density D0 of the reference white 13 is set to 1.0 and an output data voltage of the voltage-to-current converting circuit 21 in a state not causing fogging in a copy of the reference white is set to 3.0 V so that it is digitized as "1100" by the A/D converting circuit 22. FIG. 4 shows a relation between the Macbeth density D0 and the data voltage obtained by exposing documents of the Macbeth density D0 from 0.5 to 4.0. In this case, a bit resolution of the data after A/D conversion is 0.5 V.

Figure 5:
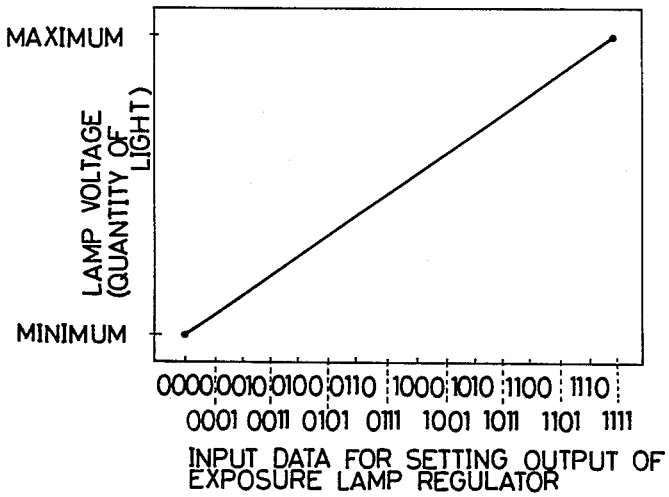
Figure 6:
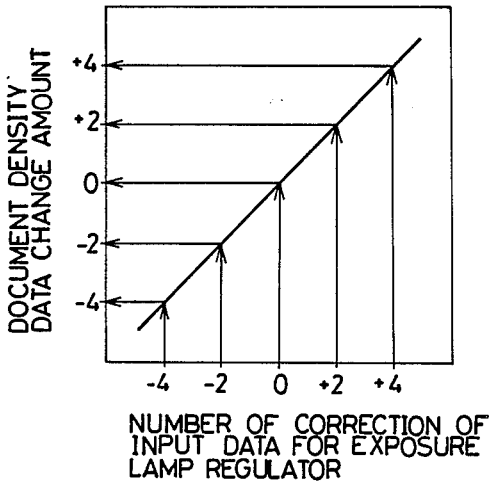

In relation to the four-bit output voltage data provided from the MPU 23 to the exposure lamp regulator 26, an output voltage to the exposure lamp 4, namely, a quantity of light applied from the exposure lamp 4 to the document is set so as to be changed in a relation as shown in FIG. 5. In addition, a change amount (number of correction) of the output voltage data to the exposure lamp regulator 26 and a change amount of the document density data after the A/D convertion are set to have a relation shown in FIG. 6. More specifically, by changing the number of correction of the input data of the exposure lamp regulator 26 by +2, the document density data after the A/D convertion can also be changed by +2. For example, it is assumed that the density data of the reference white is "1100" and that the density data of a document to be copied is "1010". If the density data of the document is subtracted from the density data of the reference white, the result obtained is a binary number "0010", which is a difference of +2 with respect to the data of the reference white. Accordingly, if the set input data of the exposure lamp regulator 26 is changed by +2 for exposure at the time of real copy operation compared with the data at the time of preliminary scanning, it can be predicted that the density data of the document becomes equal to the density data of the reference white at the time of preliminary scanning. Consequently, the set input data of the exposure lamp regulator 26 for scanning in real copy operation is set to data obtained by changing the data for preliminary scanning by +2. As stated previously, the document density data is "1010" in the above indicated evaluation. In most cases, an average value of the data read by sampling at the time of preliminary scanning is used as the document density data. Alternatively, the minimum value of sampling data may be selected as the document density data. In this embodiment, the above stated average value is adopted.

FIGS. 7, 8A to 8C and 9A to 9C are views for explaining a book dividing copy mode.

In the following, document dividing copy operation, particularly the book dividing copy mode will be described.

Figure 7:
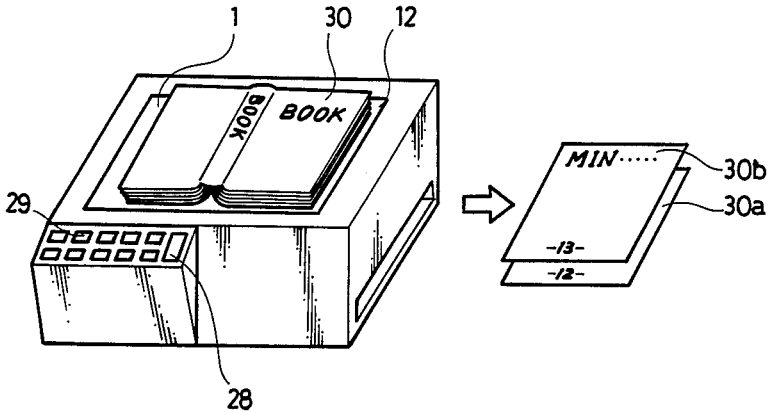

As shown in FIG. 7, in this dividing copy mode, a book 30 in an opened state is placed on the document table 1 with the right edge of the book 30 being aligned with the document scale 12 and by one operation of a print key 28, the opened two pages of the book 30 can be copied for each page as two copies 30*a* and 30*b*.

Figure 8A:
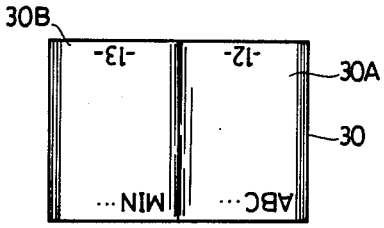
Figure 8B:
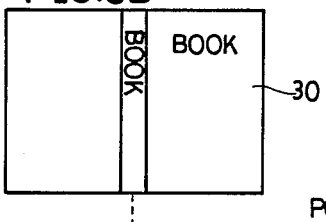

As can be seen from the thus obtained copies 30*a* and 30*b* in connection with FIGS. 8A to 8C, page 12 of the book 30, namely, a page 30A where letters ABC etc. are indicated (hereinafter, the page at the right being referred to as the face A) is copied by the first scanning in copy operation and page 13 of the book 30, namely, a page 30B where letters MIN etc. are indicated (hereinafter, the page at the left being referred to as the face B) is copied by the subsequent scanning in a copy operation. In the following, the scanning of the face A and the scanning of the face B in a copy operation will be called A scanning and B scanning, respectively. The book 30 is of the A4-size.

Figure 8C:
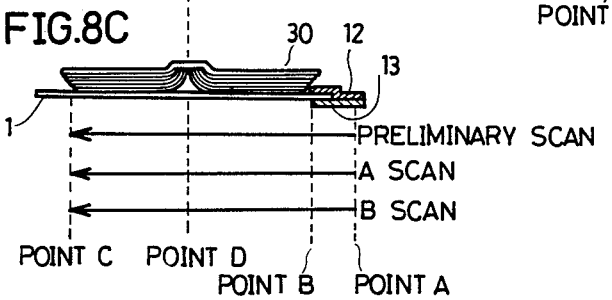

As can be seen from FIG. 8C, preliminary scanning for detecting the image density of the document is performed prior to the A scanning. After the density of the reference white 13 has been read, the image densities of the face A and the face B of the book are read successively. When the preliminary scanning is completed and the scanner is returned to the point A, the A scanning immediately starts. The exposure lamp 4 is lighted up with the optimum exposure amount according to the image density of the face A of the book 30 and the scanner moves. Paper feeding is controlled so that a leading edge of A4-size paper to be fed in the same manner as in ordinary copy operation coincides with the point B. When the scanner is returned to the point A after the A scanning, the B scanning immediately starts. The exposure lamp 4 is lighted up with the optimum exposure amount according to the image density of the face B of the book 30 and the scanner is moved from the point A. Paper feeding is controlled so that a leading edge of A4-size paper to be fed coincides with the point D attained by scanning a distance corresponding to the A4 size from the point B. As a result, two copies 30*a* and 30*b* having an appropriate image density are obtained.

The above described operation in the book dividing copy mode is started by turning on a book copy mode selection key 29 shown in FIG. 7. When the selection key 29 is turned on, the input signal is applied to the MPU 23 through the input port PA3 shown in FIG. 1. The on signal of the print key 28 is applied to the MPU 23 through the input port PA0 and the on/off signal of switch means at the point B is applied to the MPU 23 through the input port PA2.

The automatic exposure operation and the operation in the book dividing copy mode are controlled by programs in the MPU 23. The control processing procedures of the MPU 23 will be described with reference to the flow charts in FIGS. 10, 11A, 11B, 11C and 12.

Figure 10:
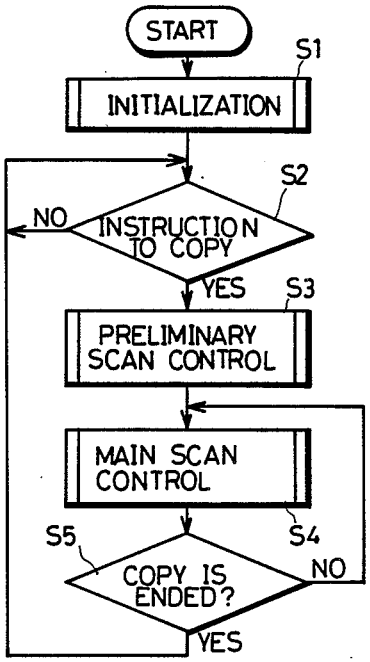
FIG. 10 is a flow chart of a main routine of an embodiment of the present invention.

FIG. 10 is a general flow chart of copy operation in this embodiment.

When the copying machine is turned on, the program starts after initial resetting. First, initialization is made in the step S1. In this step, variable items in in copy operation are initialized. For example, the number of copies is set to 1 and the magnification is set to an equal magnification mode, whereby those set conditions are displayed. If the scanner 3 (as shown in FIG. 1) is not located at the point A as the initial position, it is driven so that it is returned to the point A.

In the subsequent step S2, it is determined whether instruction for copy is issued or not, namely, whether the print key 28 is turned on or not. If an on edge of the input is determined, the program proceeds to the step S3.

The step S3 relates to a preliminary scanning control routine for detecting an image density of a document and determining the optimum exposure amount for main scanning. This routine is executed irrespective of whether the normal mode or the book dividing copy mode is selected. This routine will be more specifically described afterwards with reference to FIGS. 11A and 11B.

Figure 12:
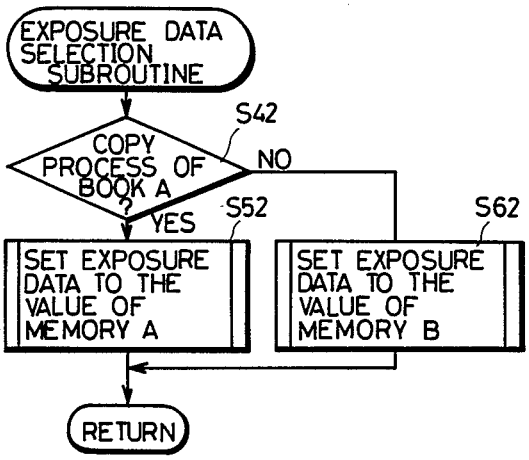
FIG. 12 is a detailed flow chart of an exposure selection subroutine.

The step S4 is a main scanning control routine for performing electrostatic copy process control. For exposure of a document, the optimum exposure amount determined in the above stated step S3 is applied. In connection with the application of the exposure amount, FIG. 12 shows a flow chart of main steps of the application in association with FIGS. 11A, 11B and 11C.

In the step S5, it is determined whether copy operation by the input predetermined number of copies is completed. If it is not completed, the program returns to the step S4 and the main scanning control routine is repeated till the predetermined number of copies are obtained. If it is completed, the program proceeds to the step S2.

Figure 11A:
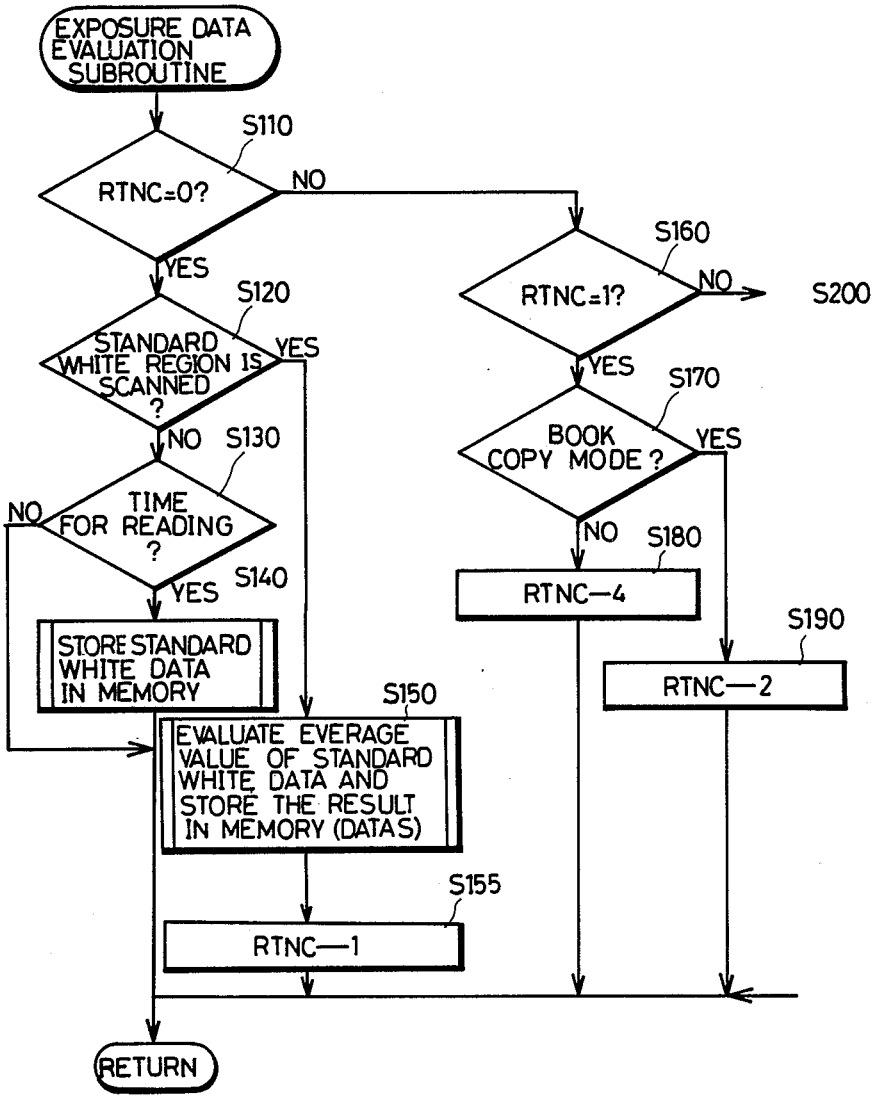
FIGS. 11A, 11B and 11C are flow charts for explaining detailed operation of an exposure data evaluation subroutine.
Figure 11B:
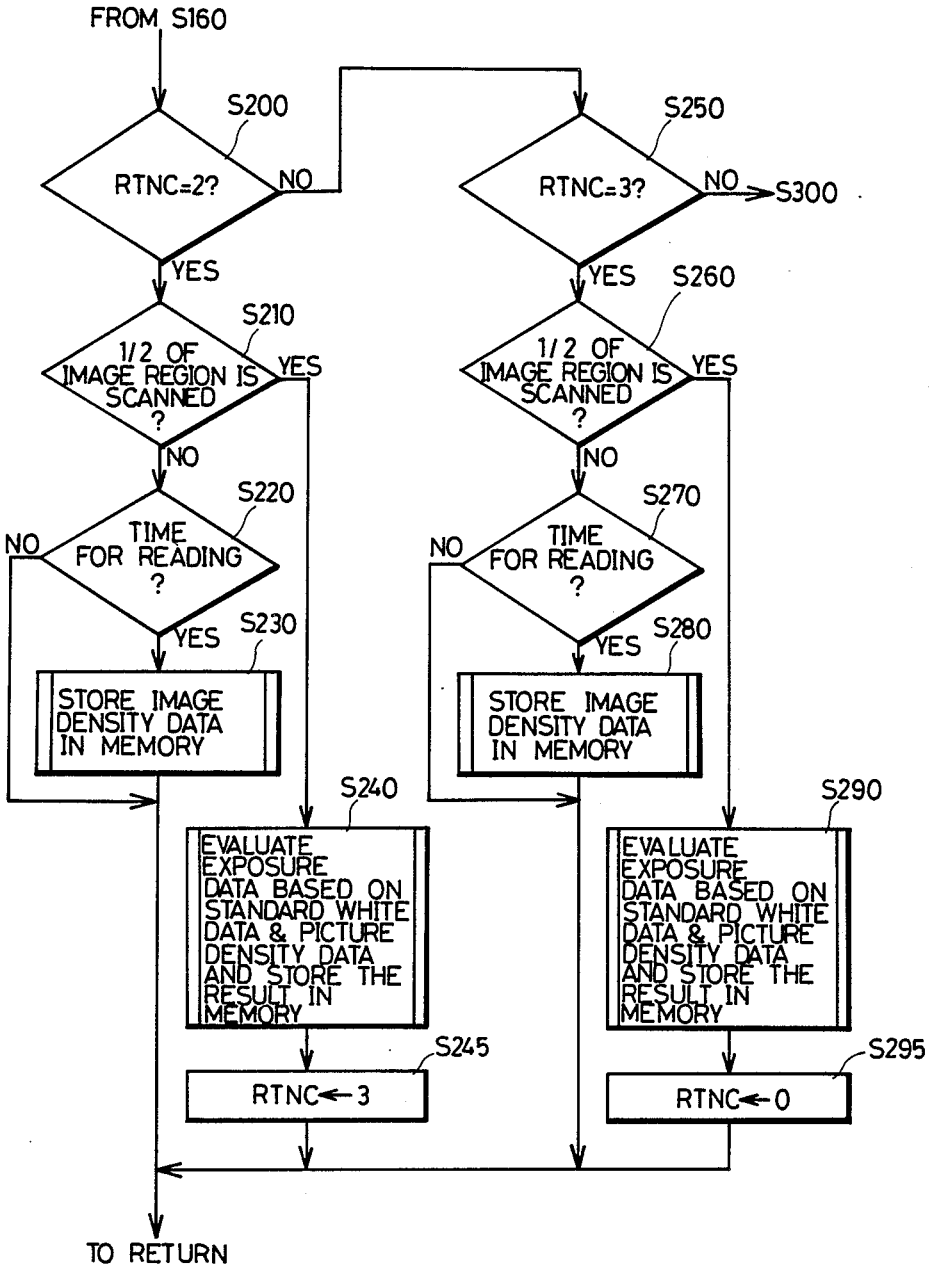
Figure 11C:
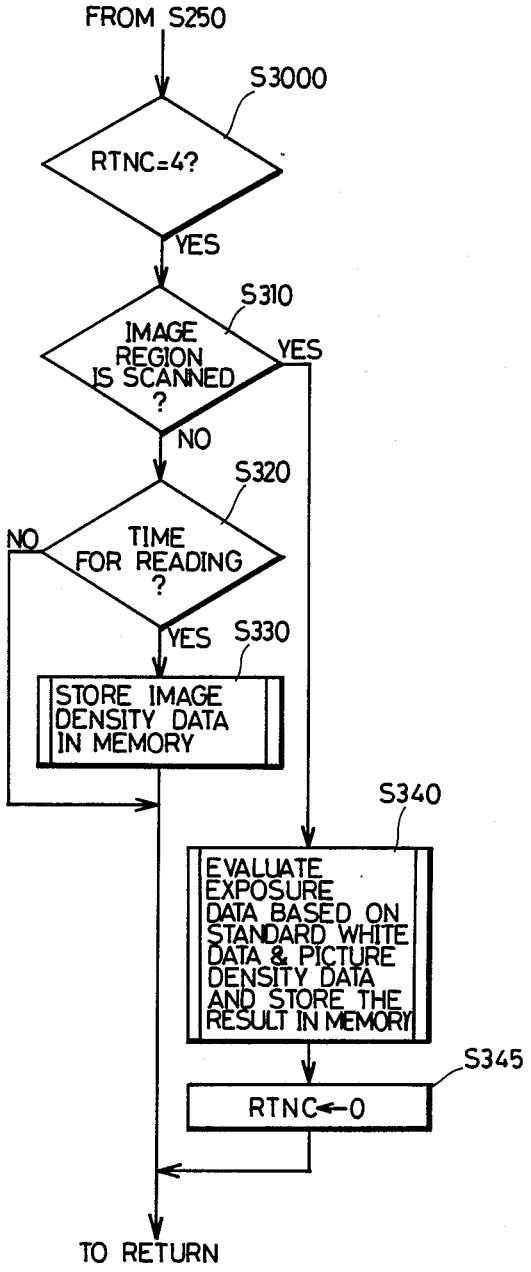

FIGS. 11A, 11B and 11C are flow charts of an exposure data evaluation subroutine showing details of the preliminary scanning control routine, particularly details of handling of the density data.

RTNC in the flow charts indicates a routine counter for numbering branch routines in the exposure data evaluation subroutine. RTNC is 0 in the step S110 immediately after the start of preliminary scanning. The MPU 23 determines in the step S120 whether scanning of the reference white region is completed. If it is completed, the MPU 23 evaluates an average value of the reference white data in the step S150 and stores the result in memory so that RTNC is 1 in the step S155. The MPU 23 determines, in the step S130, timing for reading density data in the reference white region. When it is time for reading density data, the MPU 23 stores the reference white data in a specified memory area in the step S140.

More specifically stated, referring to the steps S110 to S150 in view of FIGS. 1 to 3, when the reference white region, namely, the region from the point A to the point B is scanned, two timing pulses Tp are generated and sampling data based on the timing pulses are stored in the memory areas DATA1 and DATA2, respectively. In those steps S110 to S150, the MPU 23 performs arithmetic mean operation of those data at the end of the second timing pulse (or at the time of turning on of the switch at the point B) so that the result is stored in a memory area DATAS not shown. Thus, the average data is used as a reference for determining an exposure amount.

The MPU 23 determines in the step S160 whether RTNC is 1 or not. If RTNC is 1, the MPU 23 determines in the step S170 whether the dividing copy mode is selected. If the dividing copy mode is selected, RTNC is numbered 2 and if the dividing copy mode is not selected, RTNC is numbered 4.

If the MPU 23 determines in the above stated step S170 that the dividing copy mode is selected, it executes the routines of RTNC=2 and RTNC=3 successively. The MPU 23 determines exposure data of the face A of the book 30 in the routine of RTNC=2, namely, in the steps S210 to S245 and it determines exposure data of the face B of the book 30 in the routine of RTNC=3, namely, in the steps S260 to S295. More specifically, the MPU 23 proceeds to the step S210 if RTNC is determined to be 2 in the step S200, and then the MPU 23 proceeds to the step S210 so that it is determined whether scanning of ½ of the image area is completed or not. If it is not completed, the MPU 23 determines in the step S220 whether it is time for reading image density data.

If it is time for reading image density data, the MPU 23 proceeds to the step S230 so that the image density data is stored in memory. If the MPU 23 determines in the step S220 that it is not time for reading image density data, the MPU 23 returns to wait for the time for reading. If it is determined in the step S210 that the scanning is completed, the MPU 23 proceeds to the step S240, where exposure data is obtained based on the reference white data and the image density data and the result is stored in a memory area A (referred to hereinafter as a memory A) not shown. Then, the MPU 23 proceeds to the step S245 so that RTNC is 3.

More specifically, referring to the steps S210 to S245 in connection with FIGS. 1 to 3, the MPU 23 determines whether scanning of ½ of the image area is completed, in other words, whether scanning of an area of the A4 size (210 mm) from the point B to the point D is completed or not. If it is not completed, the MPU 23 waits for the completion and during this waiting period, the density data of the face A of the book 30 is stored successively in the memory areas DATA3 to DATA7 in response to the respective timing pulses. If the scanning is completed, the MPU 23 evaluates, in the step S240, the optimum exposure data based on the previously obtained reference white data in DATAS and the data read on this occasion. More specifically, the MPU 23 first reads the image data in the memory areas DATA3 to DATA7 and performs arithmetic mean operation of those image data. The result of the operation is stored in a memory area DATABA so as to obtain a difference ΔDATABA between the reference white data in DATAS and the content of this memory area DATABA. If the difference is 2 for example, the exposure data is obtained by incrementing the value for preliminary scanning by +2 in the same manner as described above and the value incremented by +2 is stored in the memory A as the exposure data of the face A of the book 30 for main scanning.

Then, if the MPU 23 determines in the step S250 that RTNC is 3, the program proceeds to the step S260 so that it is determined whether scanning of the remaining ½ of the image area is completed or not. If it is not completed, the MPU 23 determines in the step S270 whether it is time for reading image density data. If it is time for reading image density data, the program proceeds to the step S280 so that the MPU 23 stores the image density data in memory. If it is not time for reading image density data, the MPU 23 returns to wait for the reading timing. If the MPU 23 determines in the step S260 that the scanning is completed, it proceeds to the step S290, where exposure data is obtained based on the reference white data and the image density data and the result is stored in a memory area B (referred to hereinafter as a memory B) not shown. Then, the MPU 23 proceeds to the step S295 so that RTNC is reset to 0 because the preliminary scanning is completed.

More specifically, referring to the steps S260 to S295 in view of FIGS. 1 to 3, the MPU 23 first determines whether scanning of the remaining ½ of the image area is completed or not. If the scanning of the face B of the book 30 from the point D to the point C is completed, the MPU 23 proceeds to the step S290. During the scanning of the face B, sampled density data of the face B of the book 30 is stored successively in the memory areas DATA8 to DATA12. In the step S290, the MPU 23 performs an arithmetic mean operation of the density data and stores the result in a memory area DATABB entirely in the same manner as in the step S240, whereby a difference ΔDATABB from the average data DATAS of the reference white is obtained. If this difference is 1 for example, the optimum exposure amount for the face B of the book is obtained by changing the exposure amount for preliminary scanning by +1. Therefore, the exposure data changed by +1 is stored in the memory B as the data for the face B of the book 30 for main scanning.

On the other hand, if the MPU 23 determines in the step S170, in the routine of RTNC=1 starting from the step S160, that the dividing copy mode is not selected, RTNC is numbered 4 in the step S180 and accordingly it is determined in the step S300 that RTNC=4, whereby the program proceeds to the routine of the steps S310 to S345. The MPU 23 determines in the step S310 whether scanning of the image area is completed or not. If it is not completed, the MPU 23 proceeds to the step S320 to determine whether it is time for reading image density data. If it is time for reading image density data, the MPU 23 proceeds to the step S330 to store the image density data in memory. If the MPU 23 determines in the step S320 that it is not time for reading image density data, it returns to wait for the time for reading the image density data. In addition, if the MPU 23 determines in the step S310 that the scanning is completed, it proceeds to the step S340, where exposure data is evaluated based on the reference white data and the image density data and the result is stored in both the memory A and the memory B. Then, it proceeds to the step S345 to reset RTNC to 0 because the preliminary scanning is completed.

More specifically, referring to the steps S310 to S345 in view of FIGS. 1 to 3, the MPU 23 determines in the step S310 whether scanning of the area extending over the length of the document (of the A4 size), namely, all the image area (from the point B to the point C) is completed or not. If it is not completed, the MPU 23 waits for the completion. In this waiting period, the density data is stored successively in the memory areas DATA3 to DATA12. If it is completed, the MPU 23 proceeds to the step S340 so that it evaluates exposure data for main scanning based on the previously obtained reference white data DATAS and the data stored in the areas DATA3 to DATA12 in this period and stores the result in the memory A and the memory B.

More specifically, when the scanner 3 returns to the position of the point A, the MPU 23 reads out the contents of the memory areas DATA3 to DATA12 and performs arithmetic mean operation of those data. The result of the operation is stored temporarily in a memory area DATAI not shown and then the MPU 23 performs arithmetic operation to subtract the content of the memory area DATAI thus obtained from the content of the memory area DATAS so that a difference ΔDATA is obtained. If the result of the operation is ΔDATA=2 for example, it is only necessary to increase, by +2, input data for preliminary scanning to obtain input data (exposure data) of the exposure lamp regulator 26. The data thus obtained by increasing the exposure data for preliminary scanning by +2 is stored in both the memory A and the memory B as exposure data for main scanning.

This exposure data may be stored in a single memory area, for example a memory C. However, for the purpose of simplifying exposure control by using memory areas commonly for the above stated data and the exposure data in the dividing copy mode, the exposure data for main scanning is thus stored in different two memory areas.

FIG. 12 is a general flow chart of an exposure selection subroutine in the main scanning control routine. In the first step S42, the MPU 23 determines a copy process to be selected. If the copy process of the face A of the book is to be selected, the MPU 23 proceeds to the step S52 so that the exposure data to be supplied to the exposure lamp regulator 26 is set to the value of the memory A. Then, it returns to the main routine. If the copy process of the face B is to be selected, the MPU 23 proceeds to the step S62 so that the exposure data is set to the value of the memory B, and then, it returns to the main routine.

The copy processes of the face A and the face B of the book 30 are substantially the same as the ordinary copy process except for the above stated paper feed control and the changing of the exposure data to the value of the memory B for the change from the A scanning to the B scanning. Although the ordinary copy process uses either the value of the memory A or the value of the memory B as the exposure data, the contents of both values are the same and accordingly the quality of image never changes in this exposure selection routine. Consequently, this embodiment does not require a special control step to be added to the main scanning control routine S4 concerning the dividing copy mode except for the paper feed control for the face B of the book 30. The step S42 in FIG. 12 needs only to be defined as a variable which changes to 1 or 0 for each copy process. For example, it is only necessary to define the copy process of the face A as 1.

In the above described embodiment, after the preliminary scanning, the A scanning and then the B scanning are performed as shown in FIG. 8C. However, the B scanning may be performed before the A scanning. In the latter case, if a book is to be copied for many pages, copies to be placed one upon another in outlet trays may be arranged in order starting from the lowest page number in the uppermost outlet tray. In the present embodiment, such arrangement of the pages can be made if copy operation starts from the final page.

Figure 9A:
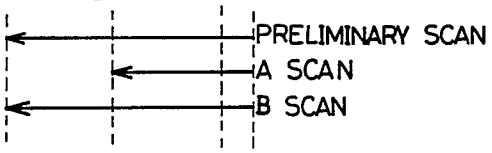
Figure 9B:
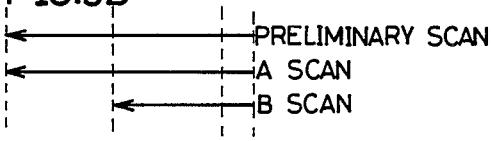
Figure 9B:
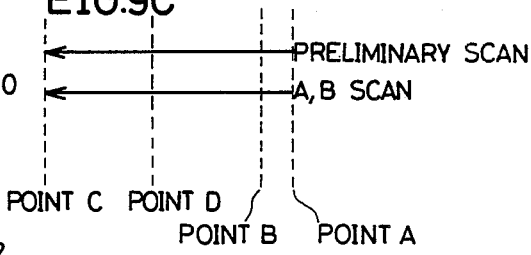

In addition, although the A scanning for copying the face A in contact with the document scale is made to attain the point C in the above described embodiment, this scanning may be made as far as the point D which is an intermediate point between the points B and C, as shown in FIGS. 9A and 9B. In such a manner, efficiency of copy operation is improved. Furthermore, if movement of the scanner can be controlled precisely, scanning may be performed only by one operation as shown in FIG. 9C without doing the A and B scanning operations. However, in such a case, it is necessary to stop movement of the scanner at an intermediate point of the scanning length for the purpose of synchronization with paper feed control.

Thus, in the document dividing copy mode by automatic exposure in accordance with the present invention, the optimum exposure amount is determined independently based on the image density of each divided region of the document so that the optimum exposure amount may be applied at the time of copy operation of each divided region. Consequently, copies of appropriate densities can always be obtained without being unfavorably influenced by a difference of densities of the divided document regions. In the above described embodiment, copies of appropriate density can be obtained by automatically controlling the exposure amount according to the detected image density. However, instead of the exposure amount, a development bias or a parameter for imaging may be controlled automatically according to the detected image density.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A scanning type copying machine comprising:

imaging means comprising scanning means for scanning a document for outputting an image of the document, mode selecting means for selecting a normal copy mode and a dividing copy mode for copying said document by dividing a copy area of said document, first control means for controlling said imaging means to copy the whole of said copy area of said document as one sheet in response to selection of said normal copy mode by said mode selecting means and to copy said document by dividing said copy area of said document into two regions in response to selection of said dividing copy mode by said mode selecting means, image density detecting means for detecting a density of said image of said document by scanning said document by said scanning means prior to copy operation, density control data setting means for setting density control data for the whole of said copy area of said document based on the detected output of said image density detecting means when said normal copy mode is selected by said mode selecting means, and for setting density control data for each of said divided two regions of said document based on the detected output of said image density detecting means when said dividing copy mode is selected by said mode selecting means, and second control means for controlling said imaging means to form a copy of an appropriate density according to the density control data set by said density control data setting means.

2. A scanning type copying machine in accordance with claim 1, wherein said image density detecting means comprises means for detecting a density of the image at a plurality of moments during the scanning by said scanning means.

3. A scanning type copying machine in accordance with claim 2, wherein said density control data setting means comprises means for setting, as the density control data, an average value of the data detected at the plurality of moments.

4. A scanning type copying machine in accordance with claim 1, wherein said scanning means comprises a lamp for lighting said document, and said second control means comprises means for controlling a quantity of light of said lamp.

5. A scanning type copying machine in accordance with claim 1, wherein said density control data setting means includes two storage areas and said density control data setting means sets the same density control data in said two storage areas based on the detected output of said image density detecting means when said normal copy mode is selected by said mode selecting means and sets in the respective storage areas density control data corresponding to the respective divided regions of said document when said dividing copy mode is selected by said mode selecting means.

6. An improved copying machine capable of copying originals with diverse indicia densities on the originals, such as a book with two pages, comprising:

means for reproducing a copy of an original;

means for selecting a mode of operation for an original with relative diverse indicia densities on two pages;

means for determining a reference signal for the reproduction cycle;

means for providing a measurement of image density of a first portion of an orignal and a second portion of an orignal, the first portion corresponding to a first page of a book and the second portion corresponding to a second page of a book;

means for determining a copy reproduction image density for the first page and the second page from the reference signal and the respective measurements of image density of the first and second pages; and means for regulating a development of the image density of copies in response to the determining means.

7. The invention of claim 6 further including a copy paper feed apparatus and means for controlling the copy paper feed apparatus to successively copy a first page and a second page.

* * * * *